US009583044B2

(12) United States Patent
Kim et al.

(10) Patent No.: US 9,583,044 B2
(45) Date of Patent: Feb. 28, 2017

(54) ORGANIC LIGHT EMITTING DISPLAY DEVICE

(71) Applicant: Samsung Display Co., Ltd., Yongin (KR)

(72) Inventors: Il Nam Kim, Hwaseong-si (KR); Rang Kyun Mok, Seoul (KR); Won Sang Park, Yongin-si (KR); Jong In Baek, Suwon-si (KR)

(73) Assignee: Samsung Display Co., Ltd., Yongin (KR)

( * ) Notice: Subject to any disclaimer, the term of this patent is extended or adjusted under 35 U.S.C. 154(b) by 19 days.

(21) Appl. No.: 14/692,316

(22) Filed: Apr. 21, 2015

(65) Prior Publication Data

US 2016/0189671 A1 Jun. 30, 2016

(30) Foreign Application Priority Data

Dec. 29, 2014 (KR) ..... 10-2014-0192087

(51) Int. Cl.
*G09G 3/3291* (2016.01)
*G09G 3/32* (2016.01)

(52) U.S. Cl.
CPC ... *G09G 3/3291* (2013.01); *G09G 2300/0452* (2013.01); *G09G 2300/0842* (2013.01); *G09G 2310/0297* (2013.01); *G09G 2340/06* (2013.01)

(58) Field of Classification Search
CPC ..... G09G 3/3291; G09G 2300/0452; G09G 2310/0297; G09G 2340/06; G09G 2300/0842
See application file for complete search history.

(56) References Cited

U.S. PATENT DOCUMENTS 9,123,289 B2 * 9/2015 Kim ..... H01L 27/32
2005/0259052 A1 * 11/2005 Shin ..... G09G 3/325 345/77
2010/0090620 A1 4/2010 Hack et al.
(Continued)

FOREIGN PATENT DOCUMENTS

KR 10-2010-0119653 11/2010
KR 10-2011-0057234 5/2011
(Continued)

*Primary Examiner* — Liliana Cerullo
(74) *Attorney, Agent, or Firm* — H.C. Park & Associates, PLC

(57) ABSTRACT

An organic light emitting display device includes a display panel including red sub-pixels, green sub-pixels, first blue sub-pixels, and second blue sub-pixels. A data drive unit receives an image signal and outputs a plurality of data output signals. A demultiplexer distributes the data signals to the red sub-pixels, the green sub-pixels and either the first blue sub-pixels or both the first and second blue sub-pixels in response a drive selection signal. A control unit processes raw image data and provides an image signal to the data drive unit, and detects image data belonging to a first color gamut and a second color gamut from the image data, determines a first blue drive area belonging to the first color gamut and a mixed drive area belonging to the second color gamut, and provides the appropriate selection signal to the demultiplexer to increase efficiency and extend useful life of the display.

18 Claims, 16 Drawing Sheets

(56) References Cited

U.S. PATENT DOCUMENTS

| | | | | |
|---|---|---|---|---|
| 2012/0105517 | A1* | 5/2012 | Yang | G09G 3/003 345/694 |
| 2012/0147065 | A1* | 6/2012 | Byun | G09G 3/3208 345/690 |
| 2015/0009194 | A1 | 1/2015 | Kim et al. | |
| 2015/0009242 | A1* | 1/2015 | Park | G09G 3/3233 345/690 |
| 2015/0248855 | A1 | 9/2015 | Kim | |
| 2016/0189670 | A1* | 6/2016 | Kim | G09G 5/02 345/690 |

FOREIGN PATENT DOCUMENTS

| | | |
|---|---|---|
| KR | 10-2013-0034740 | 4/2013 |
| KR | 10-2015-0006144 | 1/2015 |
| KR | 10-2015-0103785 | 9/2015 |

* cited by examiner

ORGANIC LIGHT EMITTING DISPLAY DEVICE

CROSS-REFERENCE TO RELATED APPLICATION

This application claims priority from and the benefit of Korean Patent Application No. 10-2014-0192087, filed on Dec. 29, 2014, which is hereby incorporated by reference for all purposes as if fully set forth herein.

BACKGROUND

Field

Exemplary embodiments relate to an organic light emitting display device, and more particularly, to an organic light emitting display device having improved display quality.

Discussion of the Background

Recently, there have been demands for reductions in the weight and thickness of monitors, televisions, portable display devices and the like. In response to such demands, existing cathode ray tube (CRT) display devices have been replaced with flat panel display devices, such as liquid crystal display (LCD) devices or organic light-emitting diode (OLED) display devices. Since the flat panel OLED display devices have high response speed, low power consumption and wide viewing angles, they have been increasingly considered for use as a next generation flat panel display device.

An organic light emitting display device is configured to include at least an organic light emitting material corresponding to red, green and blue light. Such an organic light emitting material can be degraded depending on the usage time, which may become a factor that determines the whole useful life of the organic light emitting display device.

In general, among the organic light emitting materials of a blue color, the useful life of the blue-series organic light emitting material is relatively short as compared to the organic light emitting materials of other colors. In order to ensure a long service of the display device, there is a need to improve the useful life of the blue-series organic light emitting material. Moreover, among the blue-series organic light emitting materials, a lighter sky blue-series organic light emitting material has a longer useful life than that of a darker deep blue-series organic light emitting material. Further, since the sky blue-series organic light emitting material has higher energy efficiency compared to the deep blue-series organic light emitting material, it has an advantage of reducing the power consumption of the organic light emitting display device. However, since the sky blue-series organic light emitting material has color reproducibility which is inferior to the deep blue-series, it is difficult to express a rich and natural color.

Meanwhile, in the case of the organic light emitting display device using the deep blue-series organic light emitting material, while it has excellent color reproducibility and generally superior display quality, it has problems due to the low energy efficiency and the short useful life of the display device due to the material's shorter useful life.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide an organic light emitting display device which has improved display quality and can be used for a long time.

Additional aspects will be set forth in the detailed description which follows, and, in part, will be apparent from the disclosure, or may be learned by practice of the inventive concept.

An exemplary embodiment of the present invention discloses an organic light emitting display device having a display panel including red sub-pixels, green sub-pixels, first blue sub-pixels and second blue sub-pixels respectively connected to a plurality of scan lines and a plurality of data lines; a scan drive unit that sequentially applies a plurality of scan signals to the plurality of scan lines; a data drive unit that receives an image signal and outputs a plurality of data output signals; a demultiplexer that distributes the plurality of data signals to the data lines connected to the red sub-pixels, the green sub-pixels, and the first blue sub-pixels in response to a first blue drive selection signal, or distributes the plurality of data output signals to the data lines connected to the red sub-pixels, the green sub-pixels, the first blue sub-pixels, and the second blue sub-pixels in response to a mixed drive selection signal; and a control unit that processes raw image data into an image signal and provides the image signal to the data drive unit. The control unit detects image data belonging to a first color gamut and a second color gamut from the image data, determines a first blue drive area including the image data belonging to the first color gamut and a mixed drive area including the image data belonging to the second color gamut, provides the first blue drive selection signal to the demultiplexer when the data output signal corresponding to the first blue drive area is provided from the data drive unit to the demultiplexer, and provides the mixed drive selection signal to the demultiplexer when the data output signal corresponding to the mixed drive area is provided from the data drive unit to the demultiplexer. The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
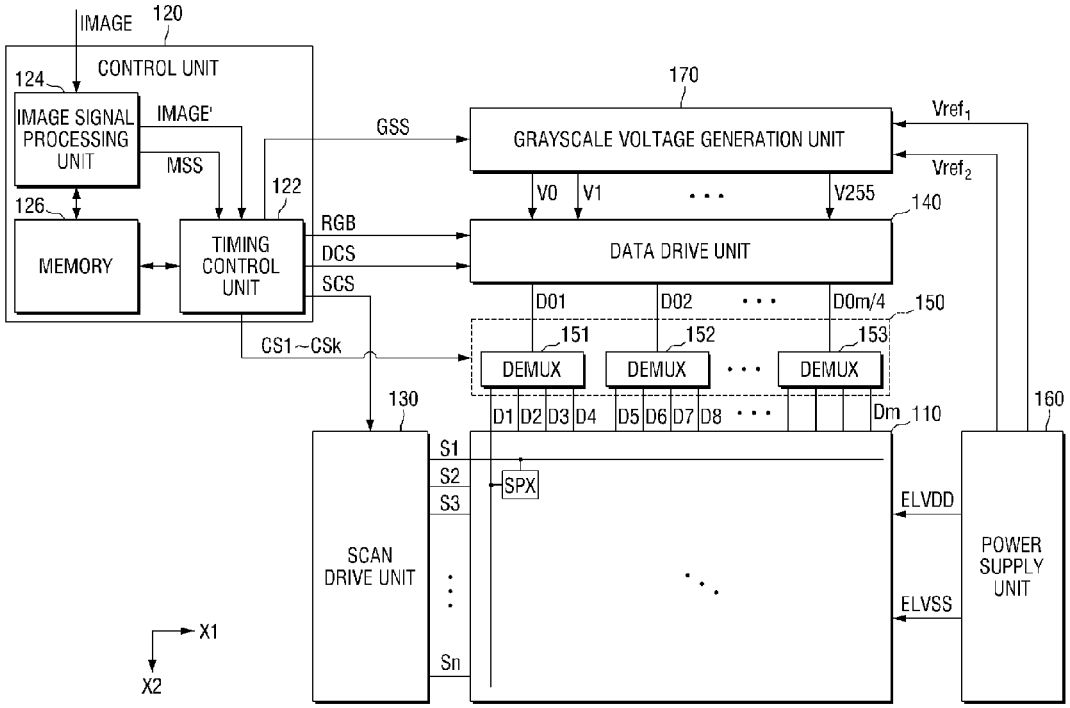
FIG. 1 is a block diagram schematically showing a configuration of an organic light emitting display device according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a block diagram schematically showing a configuration of an organic light emitting display device according to an exemplary embodiment of the present invention.

Referring to FIG. 1, the organic light emitting display device includes a display panel 110, a control unit 120, a scan drive unit 130, a data drive unit 140, a demultiplexer circuit 150, a power supply unit 160, and a grayscale voltage generation unit 170.

The display panel 110 includes a plurality of scan lines S1 to Sn extending in a first direction X1, a plurality of data lines D1 to Dm extending in a second direction X2, and a plurality of sub-pixels SPX respectively connected to the plurality of scan lines S1 to Sn and the plurality of data lines D1 to Dm. Each of the sub-pixels SPX may include a red sub-pixel R, a green sub-pixel G, a first blue sub-pixel B1, and a second blue sub-pixel B2. The configuration and operation of each of the sub-pixels SPX will be described in detail later with reference to FIGS. 2 to 4.

The control unit 120 processes image data provided from a source into an image signal RGB, and provides the image signal RGB to the data drive unit 140. In particular, in one exemplary embodiment of the present invention, the control unit 120 detects the image data belonging to a first color gamut $A_1$ and a second color gamut $A_2$ from the image data, and determines a first blue drive area including the image data belonging to the first color gamut $A_1$ and a mixed drive area including the image data belonging to the second color gamut $A_2$. Further, the control unit 120 provides a first blue drive selection signal to the demultiplexer circuit 150 when data output signals DO1 to DOm/4 corresponding to the first blue drive area are provided from the data drive unit 140 to the demultiplexer circuit 150, and provides a mixed drive selection signal to the demultiplexer circuit 150 when data output signals DO1 to DOm/4 corresponding to the mixed drive area are provided from the data drive unit 140 to the demultiplexer circuit 150.

In order to perform the functions as described above, the control unit 120 according to an exemplary embodiment of the present invention may include an image data processing unit 124, a timing control unit 122 and a memory 126.

The timing control unit 122 may receive corrected image data IMAGE' from the image data processing unit 124, process the corrected image data IMAGE' into the image signal RGB, and transmit the image signal RGB to the data drive unit 140. Further, the timing control unit 122 may output a data control signal DCS and a scan control signal SCS for driving the data drive unit 140 and the scan drive unit 130 in synchronization with the image signal RGB. The image signal RGB may be a signal obtained by processing the corrected image data IMAGE' so as to correspond to a gamma or grayscale voltage of each sub-pixel of the display panel 110. Further, the timing control unit 122 may additionally modulate or compensate the corrected image signal depending on the user's preference and the device characteristics of the organic light emitting display device, and process the corrected image signal into the image signal RGB.

Further, the timing control unit 122 may provide a sub-pixel selection signal to the demultiplexer circuit 150, and may adjust a drive mode to a first blue drive mode, a second blue drive mode, or a mixed drive mode by selecting the sub-pixel to which the data output signals DO1 to DOm/4 are applied by the demultiplexer.

The image data processing unit 124 may receive raw image data IMAGE and generate the corrected image data IMAGE'. Specifically, the image data processing unit 124 may detect the image data belonging to the first color gamut $A_1$ and the second color gamut $A_2$ from the raw image data, and determine a first blue drive area including the image data belonging to the first color gamut $A_1$ and a mixed drive area including the image data belonging to the second color gamut $A_2$. Further, the image data processing unit 124 may correct the grayscale level of the image data of a region corresponding to the mixed drive area from the raw image data IMAGE so as to match a grayscale versus voltage curve (hereinafter referred to as "first blue drive gamma curve") corresponding to the first blue drive mode.

Further, the image data processing unit 124 may store information about the positions of the first color gamut $A_1$ and the second color gamut $A_2$ and the start and end points of the first blue drive area and the mixed drive area in the memory 126, and read the information out from the memory 126. Further, the image data processing unit 124 may store the received image data or the corrected image data IMAGE' in the memory 126.

In addition, the image data processing unit 124 may transmit a mode selection signal MSS indicating whether the image data corresponds to the first blue drive area or the mixed drive area to the timing control unit 122. The timing control unit 122 may transmit drive selection signals CS1 to CSk corresponding to the received mode selection signal MSS to the demultiplexer circuit 150.

Implementation examples and operation examples of the image data processing unit 124 according to an exemplary embodiment of the present invention will be described in detail later with reference to FIGS. 6 to 8.

The memory 126 may be a non-volatile memory that can store specific information about a look-up table regarding, for example, the standard, characteristics, and the gamma curve of the display device while the power of the display device is turned off. The memory 126 may include, for example, a flash memory, an electrically erasable programmable read-only memory (EEPROM), or the like. Further, the memory 126 may include a volatile memory, such as DRAM and SRAM, capable of storing current frame image data, and information about the positions of the first color gamut $A_1$ and the second color gamut $A_2$ and the start and end points of the first blue drive area and the mixed drive area while the power of the display device is applied.

In FIG. 1, the timing control unit 122 and the image data processing unit 124 are illustrated as separate functional blocks, but embodiments are not limited thereto. For example, the image data processing unit 124 may be an algorithm that performs an image correction function according to the embodiment of the present invention as part of an image processing algorithm of the timing control unit 122. The timing control unit 122 and the image data processing unit 124 may be a single module mounted in a single IC chip. Similarly, other exemplary embodiments may use multiple separate processors.

The scan drive unit 130 may receive the scan control signal SCS from the timing control unit 122, and sequentially drive the scan lines S1 to Sn in response to the received scan control signal SCS.

The data drive unit 140 may receive the image signal RGB and the data control signal DCS from the timing control unit, and output a plurality of data output signals DO1 to DOm/4 for driving the data lines D1 to Dm in response to the received image signal RGB and data control signal DCS. For example, the data output signal DO1 may be provided to the data lines D1, D2, D3 and D4 through the demultiplexer circuit 150, and the data output signal DO2 may be provided to the data lines D5, D6, D7 and D8 through the demultiplexer circuit 150. Further, the data output signal DOm/4 may be provided to the data lines Dm-3, Dm-2, Dm-1 and Dm through the demultiplexer circuit 150.

More specifically, the data drive unit 140 may receive a plurality of grayscale voltages V0 to V255 from the grayscale voltage generation unit 170, select at least one of the received grayscale voltages V0 to V255, and transmit the selected grayscale voltage as the data output signals DO1 to DOm/4 to the demultiplexer circuit 150. Also, in one exemplary embodiment of the present invention, the data output signals DO1 to DOm/4 may be signals which are sequentially selected such that the grayscale voltages V0 to V255 applied to the red sub-pixel R, the green sub-pixel G and the first blue sub-pixel B1, or the red sub-pixel R, the green sub-pixel G, the first blue sub-pixel B1 and the second blue sub-pixel B2 are in temporal order.

The demultiplexer circuit 150 may include a plurality of demultiplexers 151 to 153. Each of the demultiplexers 151 to 153 may receive the data output signals DO1 to DOm/4, distribute the received data output signals DO1 to DOm/4 in terms of the corresponding time and selectively transmit the signals to the four data lines. For example, the demultiplexer 151 may divide the data output signal DO1 into three signals in terms of time, transmit the temporally first signal to the first data line D1 and transmit the temporally second signal to the second data line D2, and transmit the temporally third signal to the third data line D3, the fourth data line D4 or both the third and fourth data lines D3 and D4. Similarly, the demultiplexer 152 may temporally distribute the data output signal DO2 and may selectively transmit them to the four data lines D5, D6, D7 and D8. The demultiplexer circuit 150 and the data drive unit 140 are illustrated as separate functional blocks in FIG. 1, but the present invention is not limited thereto. The demultiplexer circuit 150 and the data drive unit 140 may be integrally formed in the same IC chip and may be connected to at least a part of the display panel 110. However, the demultiplexer circuit 150 and the data drive unit 140 may be integrally formed as a single drive unit IC together with the control unit 120 or the scan drive unit 130 and may be an integrated circuit formed on at least a partial area of the display panel 110.

The power supply unit 160 may be a voltage source that provides an appropriate voltage to each constituent element of the display panel 110. In particular, in one exemplary embodiment of the present invention, the power supply unit 160 may provide power supply voltages ELVDD and a ground voltage ELVSS to the plurality of sub-pixels of the display panel 110, and may provide a first reference voltage $Vref_1$ and a second reference voltage $Vref_2$ to the grayscale voltage generation unit 170.

The grayscale voltage generation unit 170 may receive at least the first reference voltage $Vref_1$ and the second reference voltage $Vref_2$ from the power supply unit 160 and may distribute the first reference voltage $Vref_1$ and the second reference voltage $Vref_2$ to generate the plurality of grayscale voltages V0 to V255.

In FIG. 1, although the grayscale voltage generation unit 170 has been illustrated to produce 256 grayscale voltages V0 to V255, the present invention is not limited thereto. Types of grayscale voltages generated by the grayscale voltage generation unit 170 may increase or decrease depending on the display quality required for the display panel 110, the panel size, and a driving method of the display panel 110 and the data drive unit 140.

Also, the grayscale voltage generation unit 170 may receive a gamma selection signal GSS provided from the timing control unit 122 and may adjust the voltage level of the plurality of grayscale voltages V0 to V255 which is outputted according to the received gamma selection signal GSS.

Figure 2:
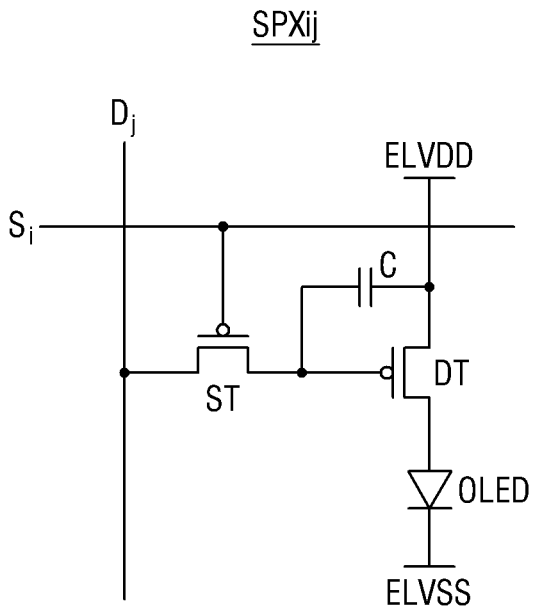
FIG. 2 is a circuit diagram illustrating an exemplary sub-pixel illustrated in FIG. 1.

FIG. 2 is a diagram illustrating an exemplary circuit of the sub-pixel illustrated in FIG. 1.

Referring to FIG. 2, the sub-pixel SPXij is connected an i-th scan line Si and a j-th data line Dj (i and j are positive integers, respectively). The sub-pixel SPXij includes a switching transistor ST, a drive transistor DT, a capacitor C1 and an organic light emitting diode OLED. The switching transistor ST transmits the data output signals DO1 to DOm/4 supplied via the data line Dj to the drive transistor DT in response to a scan signal supplied to the scan line Si.

The drive transistor DT controls the current flowing from the drive power supply voltage ELVDD to the organic light emitting diode OLED in response to the data output signals DO1 to DOm/4 that are transmitted through the switching transistor ST. The capacitor C1 is connected between the gate electrode and the ground voltage ELVDD of the drive transistor DT. The capacitor C1 stores the voltage corresponding to the data output signals DO1 to DOm/4 transmitted to the gate electrode of the drive transistor DT, and maintains the turn-on state of the drive transistor DT at the stored voltage during at least one frame.

The organic light emitting diode OLED is electrically connected between the source electrode and the ground voltage ELVSS of the drive transistor DT and emits light by the current corresponding to the data output signals DO1 to DOm/4 supplied from the drive transistor DT.

The sub-pixel SPXij may be configured to include at least one compensation transistor (not shown) and at least one compensation capacitor (not shown) for compensating a threshold voltage of the drive transistor DT as well as the above-described configuration, and may be configured to further include an emitting transistor (not shown) for selectively supplying the current supplied to the organic light emitting diode OLED from the drive transistor DT.

The sub-pixel SPXij configured as described above controls the magnitude of the current flowing to the organic light emitting diode OLED from the power supply voltage ELVDD using the switching of the drive transistor DT according to the data output signals DO1 to DOm/4 to allow the light emitting layer of the organic light emitting diode OLED to emit light, thereby expressing a predetermined color.

Meanwhile, the sub-pixel SPXij is divided into a red sub-pixel R including a red organic light emitting material, a green sub-pixel G including a green organic light emitting material, a first blue sub-pixel B1 including a sky blue organic light emitting material and a second blue sub-pixel B2 including a deep blue organic light emitting material, depending on the organic light emitting material forming the light emitting layer for the predetermined color expression.

The first and second blue sub-pixels B1 and B2 have different brightness characteristics from each other. That is, when the same voltage is applied to the anode of the organic light emitting diode OLED, brightness of the first blue sub-pixel B1 including the sky blue organic light emitting material is generally higher than that of the second blue sub-pixel B2 including the deep blue organic light emitting material.

Figure 3:
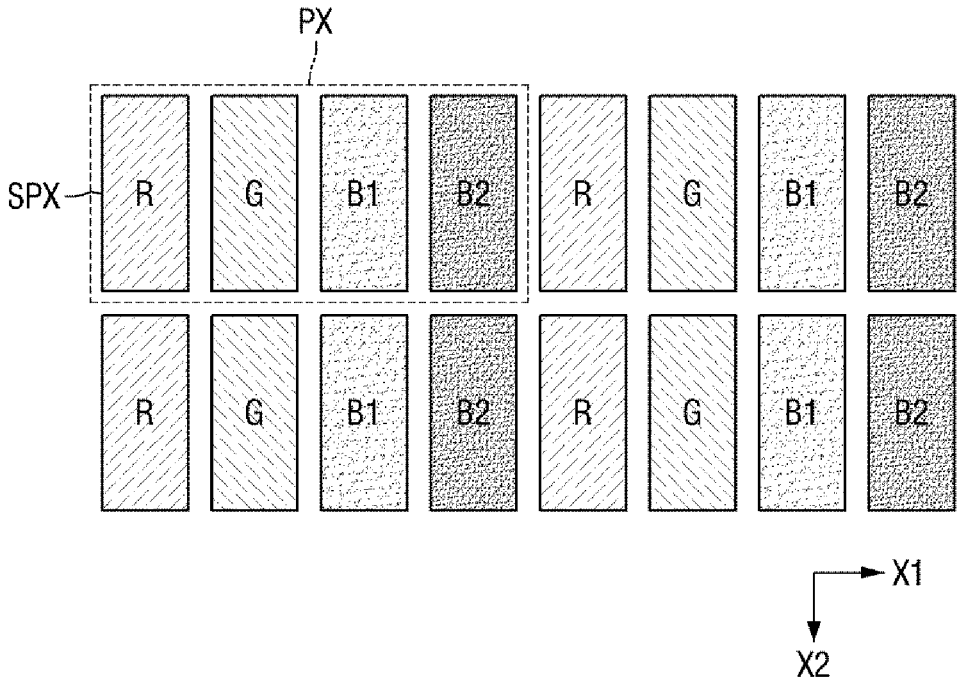
FIG. 3 is a plan diagram illustrating an exemplary pixel arrangement structure according to an exemplary embodiment of the present invention disposed on the display panel illustrated in FIG. 1.

FIG. 3 is a diagram illustrating a pixel arrangement structure according to the exemplary embodiment of the present invention disposed on the display panel illustrated in FIG. 1.

Referring to FIG. 3, the pixel PX includes four sub-pixels SPX. The four sub-pixels SPX are a red sub-pixel R, a green sub-pixel G, a first blue sub-pixel B1, and a second blue sub-pixel B2. The red sub-pixel R, the green sub-pixel G, the first blue sub-pixel B1, and the second blue sub-pixel B2 are repeatedly disposed side by side in the first direction X1. The red sub-pixel R, the green sub-pixel G, the first blue sub-pixel B1, and the second blue sub-pixel B2 are arranged such that the same sub-pixels are disposed in the second direction X2.

The red sub-pixel R, the green sub-pixel G, the first blue sub-pixel B1, and the second blue sub-pixel B2 within one pixel PX are connected to the same scan line and are connected to the four data lines, respectively.

As used herein, "pixel" corresponds to one "point" in the image data in which a plurality of "points" gather to form one image, and "sub-pixel" corresponds to one point, (e.g., R pixel, G pixel and B pixel) of the plurality of points on the display panel 110 for expressing one "pixel or point."

Figure 4:
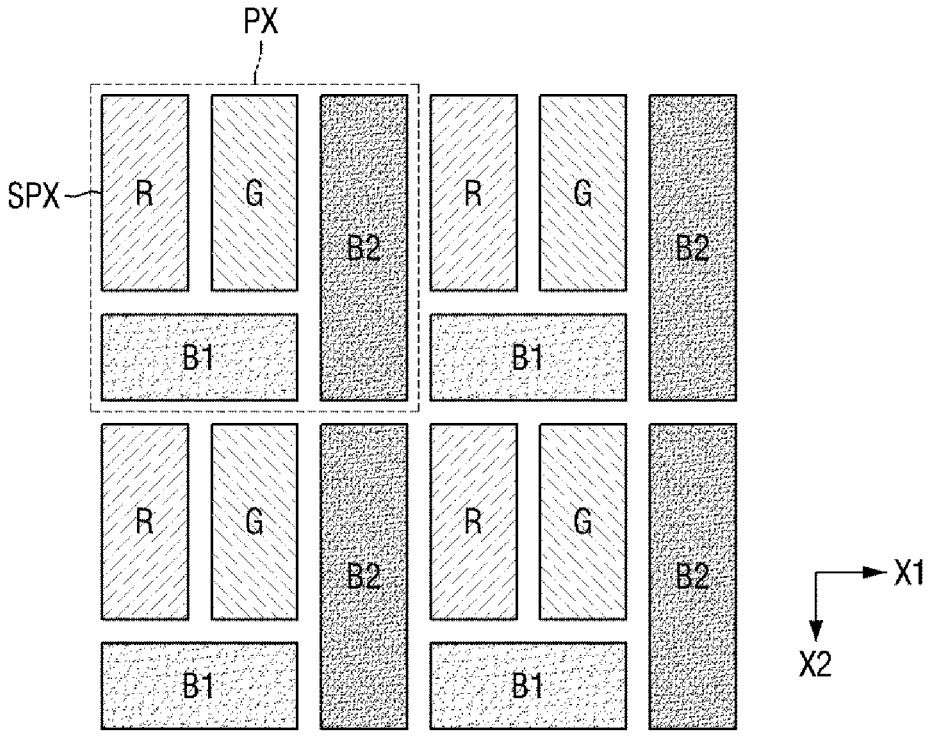
FIG. 4 is a diagram illustrating an exemplary pixel arrangement structure according to another exemplary embodiment of the present invention disposed on the display panel illustrated in FIG. 1.

FIG. 4 is a diagram illustrating a pixel arrangement structure according to another exemplary embodiment of the present invention disposed on the display panel illustrated in FIG. 1.

Referring to FIG. 4, the pixel PX includes four sub-pixels SPX. The four sub-pixels SPX are the red sub-pixel R, the green sub-pixel G, the first blue sub-pixel B1, and the second blue sub-pixel B2. The red sub-pixel R, the green sub-pixel G, and the second blue sub-pixel B2 are repeatedly arranged side by side in the first direction X1. The red sub-pixel R and the first blue sub-pixel B1 are sequentially arranged in the second direction X2, and the length of the first blue sub-pixel B1 in the first direction X1 is the same as the sum of the lengths of the red sub-pixel R and the green sub-pixel G in the first direction X1. The length of the second blue sub-pixel B2 in the second direction X2 is the same as the sum of the lengths of the green sub-pixel G and the first blue sub-pixel B1 in the second direction X2.

The red sub-pixel R, the green sub-pixel G, the first blue sub-pixel B1, and the second blue sub-pixel B2 within one pixel PX are connected to the same scan line and are connected to the four data lines, respectively.

Figure 5:
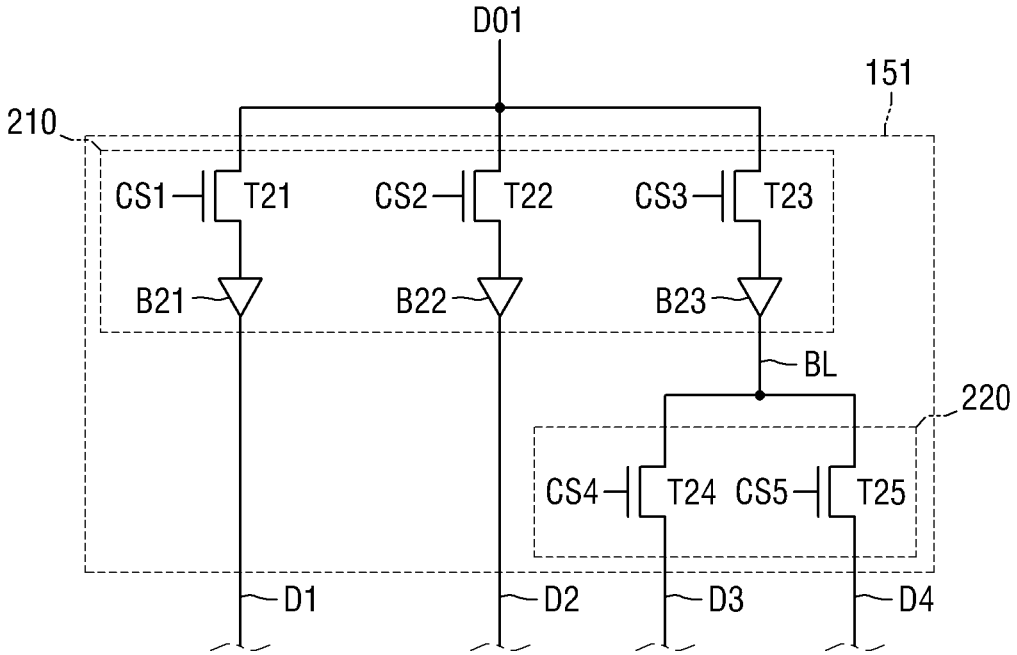
FIG. 5 is a circuit diagram illustrating an exemplary configuration of a demultiplexer illustrated in FIG. 1.

FIG. 5 is a circuit diagram illustrating a configuration of the demultiplexer illustrated in FIG. 1. Since the demultiplexers 152 and 153 illustrated in FIG. 1 are configured in the same manner as the demultiplexer 151 illustrated in FIG. 5, specific drawings of the demultiplexers 152 and 153 will be omitted.

Referring to FIG. 5, the demultiplexer 151 includes a first selection circuit 210 and a second selection circuit 220. The first selection circuit 210 outputs the data output signal DO1 to any one of the first data line D1, the second data line D2 and the blue line BL in response to drive selection signals CS1 to CS3 from the timing control unit 122 illustrated in FIG. 1. The selection signals CS1 to CS3 are the red selection signal CS1, the green selection signal CS2, and the blue selection signal CS3, respectively.

The first selection circuit 210 may include first to third transistors T21 to T23 and first to third buffers B21 to B23. The first transistor T21 may be connected between the data output signal DO1 and the input terminal of the first buffer B21 and may include a gate electrode connected to the red selection signal CS1. The second transistor T22 may be connected between the data output signal DO1 and the input terminal of the second buffer B22 and may include a gate electrode connected to the green selection signal CS2. The third transistor T23 may be connected between the data output signal DO1 and the input terminal of the third buffer B23, and may include a gate electrode connected to the blue selection signal CS3.

The first buffer B21 is connected between the first transistor T21 and the first data line D1. The second buffer B22 is connected between the second transistor T22 and the second data line D2. The third buffer B23 is connected between the third transistor T23 and the blue line BL.

The second selection circuit 220 outputs the data output signal DO1 of the blue line BL to any one of the third data line D3 and the fourth data line D4 in response to the selection signals CS4 and CS5 from the timing control unit illustrated in FIG. 1. The selection signals CS4 and CS5 are the first blue selection signal CS4 and the second blue selection signal CS5.

The second selection circuit 220 includes a fourth transistor T24 and a fifth transistor T25. The fourth transistor T24 is connected between the blue line BL and the third data line D3, and includes a gate electrode connected to the first blue selection signal CS4. The fifth transistor T25 is connected between the blue line BL and the fourth data line D4, and includes a gate electrode connected to the second blue selection signal CS5.

Each of the first blue selection signal CS4 and the second blue selection signal CS5 may adjust whether the first blue sub-pixel B1 connected to the third data line D3 or the second blue sub-pixel B2 connected to the fourth data line D4 emits light. The drive mode of the organic light emitting display device according to exemplary embodiments of the present invention may vary depending on whether the first blue sub-pixel B1 and the second blue sub-pixel B2 emit light.

In this specification, the drive mode, in which the first blue sub-pixel B1 emits light and the second blue sub-pixel B2 does not emit light, is defined as a "first blue drive mode." In this case, the first blue selection signal CS4 in an on-state and the second blue selection signal CS5 in an off-state may be referred to as a "first blue drive selection signal." Further, the drive mode, in which both the first blue sub-pixel B1 and the second blue sub-pixel B2 emit light, is defined as a "mixed drive mode." In this case, both the first blue selection signal CS4 and the second blue selection signal CS5 in the on-state may be referred to as a "mixed drive selection signal." Furthermore, the drive mode in which the first blue sub-pixel B1 does not emit light and the second blue sub-pixel B2 emits light, is defined as a "second blue drive mode." In this case, the first blue selection signal CS4 in the on-state and the second blue selection signal CS5 in the off-state may be referred to as a "second blue drive selection signal."

Next, the configuration and operation of the image data processing unit 124 according to an exemplary embodiment of the present invention will be described in detail with reference to FIGS. 6 to 8.

Figure 6:
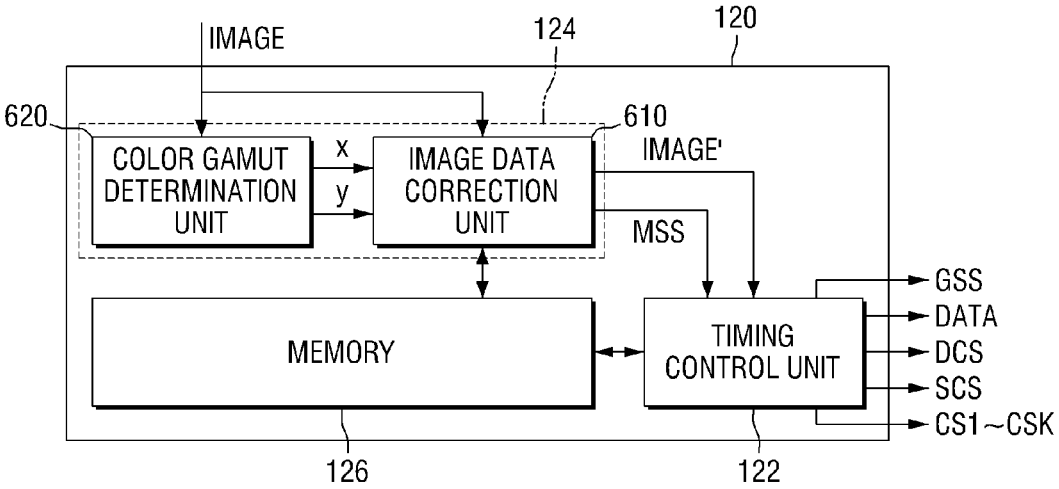
FIG. 6 is a block diagram schematically illustrating a control unit according to an exemplary embodiment of the present invention.

FIG. 6 is a block diagram schematically illustrating a control unit 120 according to an exemplary embodiment of the present invention.

Figure 7:
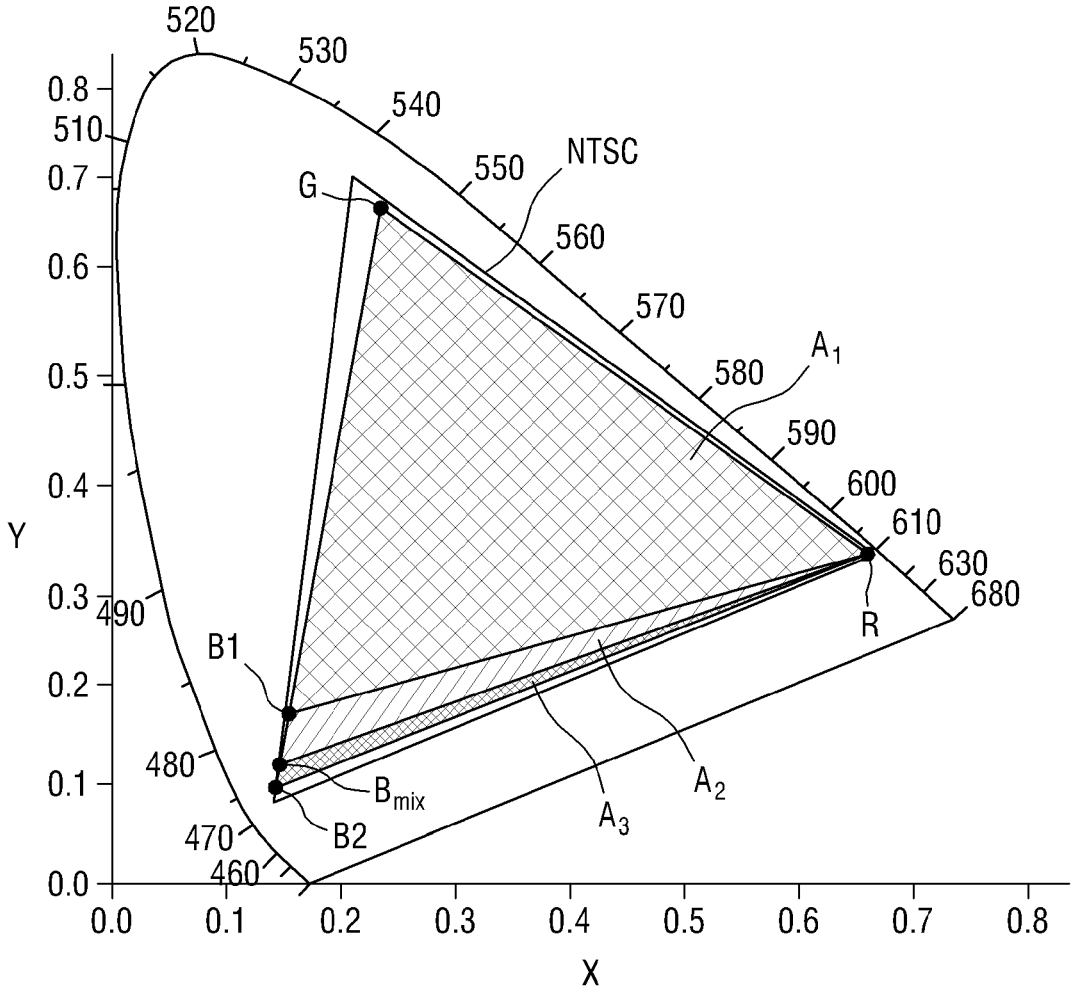
FIG. 7 is a color coordinate diagram illustrating a color gamut in which the first blue drive mode, the second blue drive mode, and the mixed drive mode can be expressed in International Commission on Illumination (CIE) 1931 RGB color space coordinates.

FIG. 7 is a color coordinate diagram illustrating a color gamut in which the first blue drive mode, the second blue drive mode, and the mixed drive mode can be expressed on the CIE color coordinates.

Figure 8:
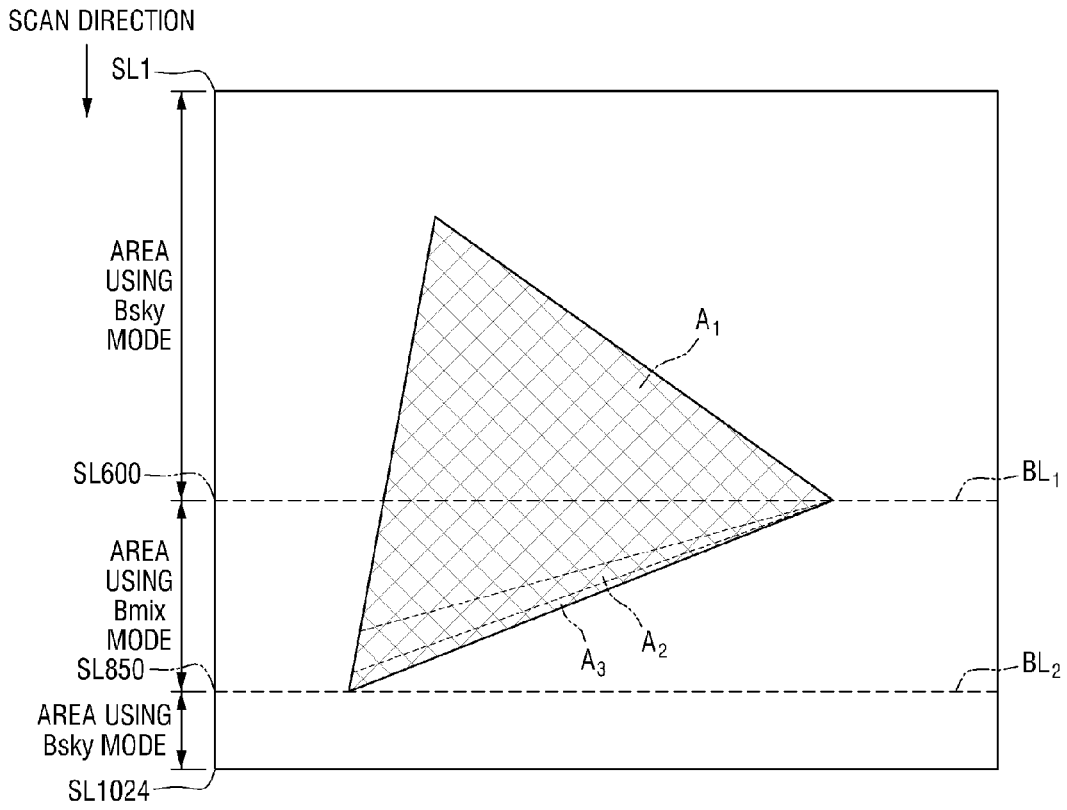
FIG. 8 is an exemplary diagram illustrating that the same image data as the color gamut illustrated in FIG. 7 is displayed on the display panel.

FIG. 8 is an exemplary diagram illustrating that the same image data as the color gamut illustrated in FIG. 7 is displayed on the display panel.

Referring to FIG. 6, the image data processing unit 124 according to an exemplary embodiment of the present invention may include an image data correction unit 610 and a color gamut determination unit 620.

The color gamut determination unit 620 may receive the raw image data IMAGE and may determine which color gamut on the color coordinates each of the pixels or points of the raw image data IMAGE belongs to.

In this regard, referring to FIG. 7, the first blue sub-pixel B1 emits light in a relatively light blue color as compared to the second blue sub-pixel B2, and a combination of the first blue sub-pixel B1, the red sub-pixel R, and the green sub-pixel G can display the color in the first color gamut $A_1$.

When both the first blue sub-pixel B1 and the second blue sub-pixel B2 emit light, a combination of the first blue sub-pixel B1, the second blue sub-pixel B2, the red sub-pixel R and the green sub-pixel G may display light of the first color gamut $A_1$ and the second color gamut $A_2$. In other words, the second color gamut $A_2$ may be defined as a gamut in which the first color gamut $A_1$ is excluded from the color gamut which can be expressed when all the first blue sub-pixel B1, the second blue sub-pixel B2, the red sub-pixel R and the green sub-pixel G emit light.

The second blue sub-pixel B2 emits light in a darker blue color as compared to the first blue sub-pixel B1, and a combination of the second blue sub-pixel B2, the red sub-pixel R, and the green sub-pixel G may display light of the first color gamut $A_1$, the second color gamut $A_2$ and a third color gamut $A_3$. In other words, the third color gamut $A_3$ may be defined as a gamut in which the first color gamut $A_1$ and the second color gamut $A_2$ are excluded from the color gamut which can be expressed when all the second blue sub-pixel B2, the red sub-pixel R, and the green sub-pixel G emit light.

Referring back to FIG. 6, the color gamut determination unit 620 may provide position values (x, y) of the pixels belonging to the second color gamut $A_2$ or the third color gamut $A_3$ to the image data correction unit 610, from the color coordinate values of each pixel of the raw image data IMAGE.

Further, the color gamut determination unit 620 may determine the first positions of the pixels belonging to the second color gamut $A_2$ or the third color gamut $A_3$ and the final positions of the pixels belonging to the second color gamut $A_2$ or the third color gamut $A_3$ in a scan direction, i.e., a direction in which the scan lines are sequentially enabled, or a direction in which the data lines generally extend, in the raw image data IMAGE, and may determine, as a mixed drive area, an area from the first positions to the final positions of the pixels belonging to the second color gamut $A_2$ or the third color gamut $A_3$. Further, the color gamut determination unit 620 may determine, as a first blue drive area, an area where only the pixels belonging to the first color gamut $A_1$ exist in the scan direction in the raw image data IMAGE.

In this regard, referring to FIG. 8, FIG. 8 illustrates that the same image as the first to third gamuts $A_1$, $A_2$, and $A_3$ shown in FIG. 7 on the CIE color coordinates is displayed on the display panel 110, the display panel 110 has 1024 rows of pixels in the vertical direction, and the image data has 1024 rows of pixels in the scan direction.

With respect to the image shown in FIG. 8, in the scan direction, the image data corresponding to the first scan line SL1 to the 599th scan line includes only the image data belonging to the first color gamut $A_1$. That is, the image data corresponding to the first scan line SL1 to the 599th scan line may be determined as the first blue drive area. With respect to the first blue drive area, the Bsky mode or the first blue drive mode using only the first blue sub-pixel B1 is used, and the color for the corresponding image data can be reproduced.

Further, with respect to the image shown in FIG. 8, in the scan direction, the image data corresponding to the 600th scan line SL600 to the 850th scan line SL850 includes the image data belonging to the second color gamut $A_2$ or the third color gamut $A_3$. That is, the image data corresponding to the 600th scan line SL600 to the 850th scan line SL850 may be determined as the mixed drive area. With respect to the mixed drive area, the mixed drive mode or the Bmix mode is used, and it is possible to achieve the color reproducibility that is required.

Further, with respect to the image shown in FIG. 8, in the scan direction, the image data corresponding to the 851th scan line SL851 to the 1024th scan line SL1024 includes only the image data belonging to the first color gamut $A_1$. That is, the image data corresponding to the 851th scan line SL851 to the 1024th scan line SL1024 may be determined as the first blue drive area. With respect to the first blue drive area, the first blue drive mode or the Bsky mode is used, and the color for the corresponding image data can be reproduced.

Although FIG. 8 illustrates that the mixed drive mode or the Bmix mode is used with respect to the image data belonging to the third color gamut $A_3$, the present invention is not limited thereto. According to another exemplary embodiment of the present invention, the color gamut determination unit 620 may determine, as a second blue drive area, an area from the first positions to the final positions of the pixels belonging to the third color gamut $A_3$ in the scan direction in the raw image data IMAGE.

Referring back to FIG. 6, the image data correction unit 610 may receive the position values (x, y) of the pixel belonging to the second color gamut $A_2$ or the third color gamut $A_3$ in the raw image data IMAGE from the color gamut determination unit 620, or values for a start point $BL_1$ and an end point $BL_2$ of the mixed drive area, and may correct the image data of the mixed drive area to match the mixed drive mode. The reason and its principle in which the image data correction unit 610 corrects the image data to match the mixed drive mode will be described in detail with reference to FIG. 10.

The timing control unit 122 receives the corrected image data IMAGE' from the image data correction unit 610, and provides the demultiplexer circuit 150 with the mixed drive selection signal, that is, the first blue selection signal CS4 and the second blue selection signal CS5 in the on-state, when the data output signals DO1 to DOm/4 equivalent to the image data belonging to the mixed drive area are provided from the data drive unit 140 to the demultiplexer circuit 150.

Figure 9:
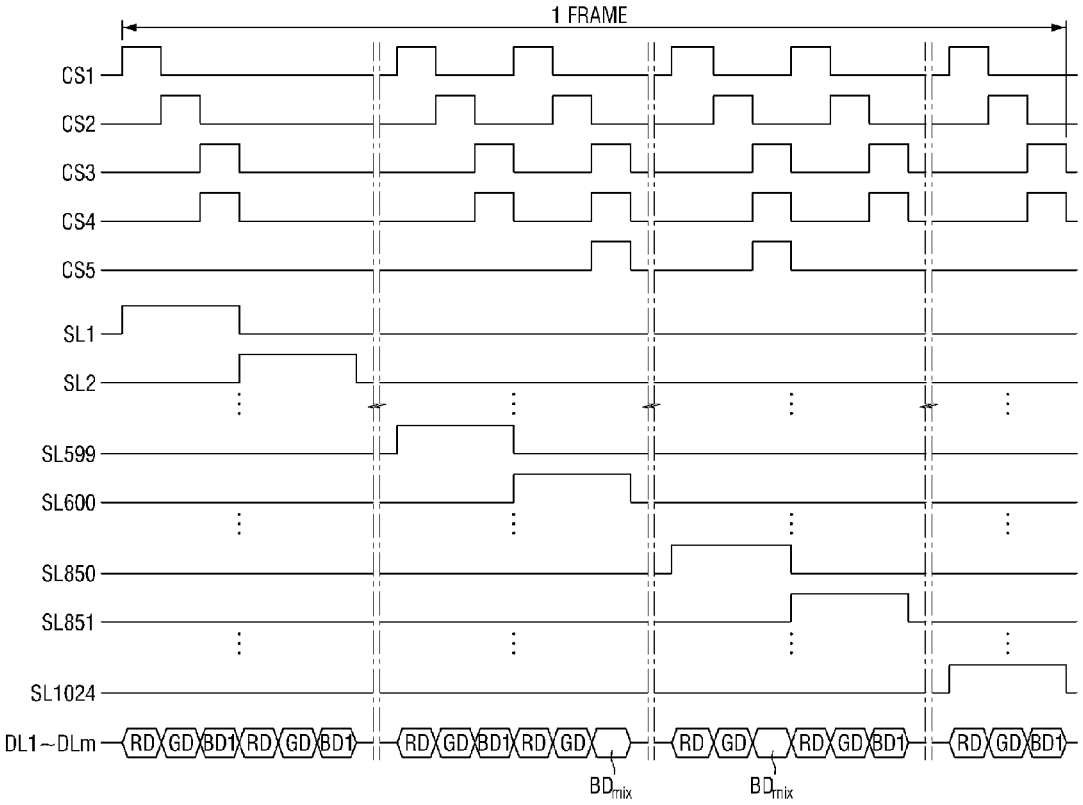
FIG. 9 is an exemplary timing diagram illustrating the data output signals and the selection signals applied to the demultiplexer circuit, and the scan signals applied to the scan lines for one frame when the image shown in FIG. 8 is displayed.

FIG. 9 is a timing diagram illustrating the data output signals and the selection signals applied to the demultiplexer circuit, and the scan signals applied to the scan lines for one frame when the image shown in FIG. 8 is displayed.

Referring to FIG. 9, the data output signals DO1 to DOm/4 applied to the demultiplexer circuit 150 may be signals to which the red data signal RD and the green data signal GD are sequentially applied by being divided temporally, and then, the first blue data signal BD1 or the mixed blue data signal BDmix is applied.

A turn-on signal may be applied to each scan line during one interval of the data output signals DO1 to DOm/4 to which the red data signal RD, the green data signal GD and one of the first blue data and the mixed blue data are sequentially applied once.

Each of the red selection signal CS1 and the green selection signal CS3 is synchronized with the red data signal RD and the green data signal GD and may maintain the state of the turn-on signal during the interval in which the red data signal RD and the green data signal GD are applied.

The blue selection signal CS3 may maintain the state of the turn-on signal while the first blue data signal BD1 or the mixed blue data signal BDmix is applied.

While the organic light emitting display device according to an exemplary embodiment of the present invention operates in the first blue drive mode, the blue selection signal CS3 and the first blue selection signal CS4 may maintain the state of the turn-on signal. While the device operates in the mixed drive mode, all the blue selection signal CS3, the first blue selection signal CS4 and the second blue selection signal CS5 may maintain the turn-on state.

In FIG. 8, the image corresponding to the first scan line to the 599th scan line may be determined as the first blue drive area. Accordingly, as shown in FIG. 9, while the turn-on signal, i.e., the scan signal, is applied to the first scan line to the 599th scan line, the red selection signal CS1 and the green selection signal CS2 are sequentially applied to the demultiplexer circuit 150, and then, the blue selection signal CS3 and the first blue selection signal CS4 may be simultaneously applied to the demultiplexer circuit 150.

In FIG. 8, the image corresponding to the 600th scan line to the 850th scan line may be determined as the mixed drive area. Accordingly, as shown in FIG. 9, while the turn-on signal, i.e., the scan signal, is applied to the 600th scan line, the red selection signal CS1 and the green selection signal CS2 are sequentially applied to the demultiplexer circuit 150, and then, the blue selection signal CS3, the first blue selection signal CS4 and the second blue selection signal CS5 may be simultaneously applied to the demultiplexer circuit 150.

In FIG. 8, the image corresponding to the 851th scan line to the 1024th scan line may be determined as the first blue drive area. Accordingly, as shown in FIG. 9, while the turn-on signal, i.e., the scan signal, is applied to the 851th scan line, the red selection signal CS1 and the green selection signal CS2 are sequentially applied to the demultiplexer circuit 150, and then, the blue selection signal CS3 and the first blue selection signal CS4 may be simultaneously applied to the demultiplexer circuit 150.

Although not shown, according to another exemplary embodiment of the present invention, with respect to the second blue drive area, an organic light emitting display device may operate in a separate second blue drive mode instead of the mixed drive mode. In this case, while the turn-on signal, i.e., the scan signal, is applied to the scan line corresponding to the second blue drive area, the red selection signal CS1 and the green selection signal CS2 are sequentially applied to the demultiplexer circuit 150, and then, the blue selection signal CS3 and the second blue selection signal CS5 may be simultaneously applied to the demultiplexer circuit 150.

Next, referring to FIG. 10, the reason and its principle will be described in which the image data correction unit 610 corrects the image data to match the mixed drive mode.

Figure 10:
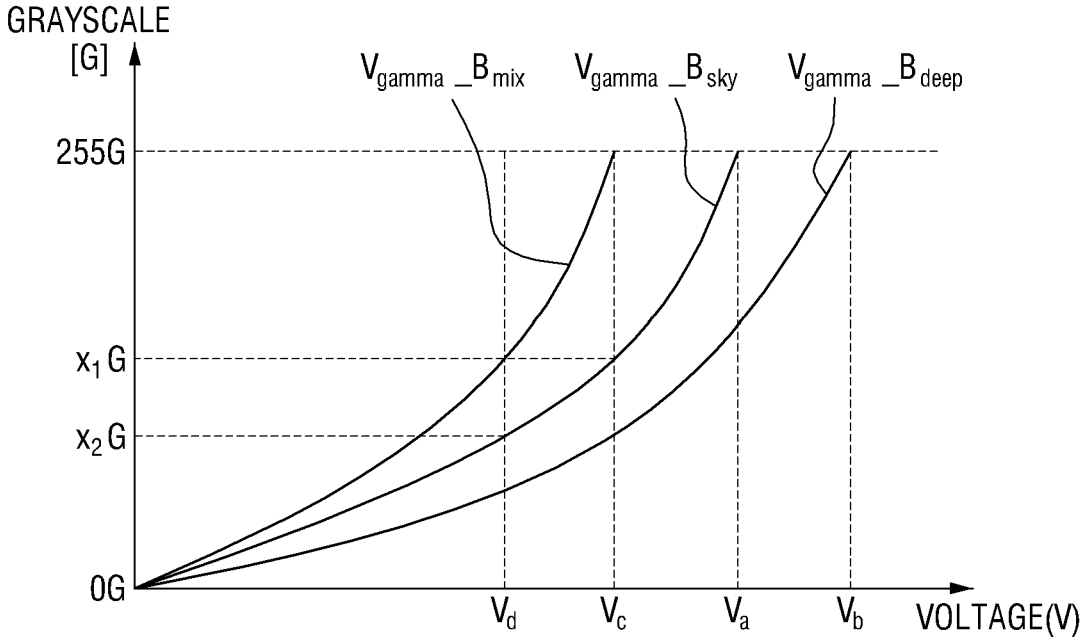
FIG. 10 is an exemplary graph illustrating a voltage versus gamma curve of the first blue drive mode, the second blue drive mode, and the mixed drive mode.

FIG. 10 is graph exemplarily illustrating a voltage versus grayscale curve of the first blue drive mode, the second blue drive mode, and the mixed drive mode.

Referring to FIG. 10, the first blue gamma curve Vgamma_Bsky is a curve illustrating the grayscale versus voltage when only the first blue sub-pixel B1 emits light in the first blue drive mode. The second blue gamma curve Vgamma_Bdeep is a curve illustrating the grayscale versus voltage when only the second blue sub-pixel B2 emits light in the second blue drive mode. The mixed blue gamma curve Vgamma_Bmix is a curve illustrating the grayscale versus voltage when both the first blue sub-pixel B1 and the second blue sub-pixel B2 emit light in the mixed drive mode.

In general, the first blue sub-pixel B1 in a sky blue color may have higher luminous efficiency as compared to the second blue sub-pixel B2 in a deep blue color. That is, when the same voltage is applied to the first blue sub-pixel B1 and the second blue sub-pixel B2, the first blue sub-pixel B1 may emit light of the higher brightness or grayscale.

As illustrated in FIG. 10, the voltage Va when the first blue sub-pixel B1 emits light with maximum brightness or grayscale 255G may be lower than the voltage Va when the second blue sub-pixel B2 emits light with maximum brightness or grayscale 255G.

In the mixed drive mode, if the light emitting area of the first blue sub-pixel B1 and the second blue sub-pixel B2 is the same as one of the first blue sub-pixel B1 and the second blue sub-pixel B2, it is possible to predict that the mixed blue gamma curve Vgamma_Bmix be located in an intermediate area between the first blue gamma curve Vgamma_Bsky and the second blue gamma curve Vgamma_Bdeep.

However, in the organic light emitting display according to an exemplary embodiment of the present invention, since the mixed drive mode allows both the first blue sub-pixel B1 and the second blue sub-pixel B2 to emit light, an area that emits light in one pixel, i.e., four sub-pixels in the mixed drive mode is the sum of the first blue sub-pixel B1 and the second blue sub-pixel B2, and the mixed blue gamma curve Vgamma_Bmix may be located on the left side compared to the first blue gamma curve Vgamma_Bsky.

That is, in the first blue drive mode, the voltage Va when the first blue sub-pixel B1 emits light with maximum brightness or grayscale 255G may be greater than the voltage Vc when all the first blue sub-pixel B1 and the second blue sub-pixel B2 emit light at maximum brightness in the mixed drive mode to express the maximum grayscale 255G.

For example, the voltage Vc when expressing the maximum grayscale 255G in the mixed drive mode may correspond to a first grayscale value xG that is lower than the maximum grayscale 255G in the first blue gamma curve Vgamma_Bsky.

In an exemplary embodiment of the present invention, the grayscale voltage generation unit 170 may provide the data drive unit 140 with a plurality of grayscale voltages V0 to V255 corresponding to the first blue gamma curve Vgamma_Bsky, and the data drive unit 140 may select a part of the plurality of grayscale voltages V0 to V255 corresponding to the first blue gamma curve Vgamma_Bsky depending on the input image signal and may supply it to the demultiplexer circuit 150 as the data output signals DO1 to DOm/4.

That is, when operating in the first blue drive mode for any pixel of the image data having the first grayscale value xG, the data drive unit 140 may select the voltage Vc as the data output signals DO1 to DOm/4 and may allow the first blue sub-pixel B1 to emit light with brightness corresponding to the first grayscale value xG.

However, for any pixel of the image data having the first grayscale value xG, if the grayscale voltage generation unit 170 provides the data drive unit 140 with the plurality of grayscale voltages V0 to V255 corresponding to the first blue gamma curve Vgamma_Bsky, when operating in the mixed drive mode, the data drive unit 140 may select the voltage Vc as the data output signals DO1 to DOm/4, and the first blue sub-pixel B1 and the second blue sub-pixel B2 may emit light with brightness corresponding to the maximum grayscale 255G.

In order to express the first grayscale xG without changing the plurality of grayscale voltages V0 to V255 generated by the grayscale voltage generation unit 170 in the mixed drive mode, the image data correction unit 610 of the organic light emitting display device according to the embodiment of the present invention may correct the image data of the mixed drive area with reference to the first blue gamma curve Vgamma_Bsky and the mixed blue gamma curve Vgamma_Bmix.

For example, in the mixed drive mode, in order to express one pixel having the first grayscale value $x_1G$, the voltage Vd corresponding to the first grayscale value $x_1G$ in the mixed blue gamma curve Vgamma_Bmix may find the corresponding second grayscale value $x_2G$ on the first blue gamma curve Vgamma_Bsky, and may correct the image data having the first grayscale value x1G of the mixed drive area to the image data having the second grayscale value $x_2G$.

In other words, the image data correction unit 610 may correct the image data of the mixed drive area to match the first blue gamma curve Vgamma_Bsky. For example, the correction may be performed by a calculation formula based on the curve equation of the first blue gamma curve Vgamma_Bsky and the mixed blue gamma curve Vgamma_Bmix, or may be performed by referring to the conversion look-up table stored in the memory 126.

Figure 11:
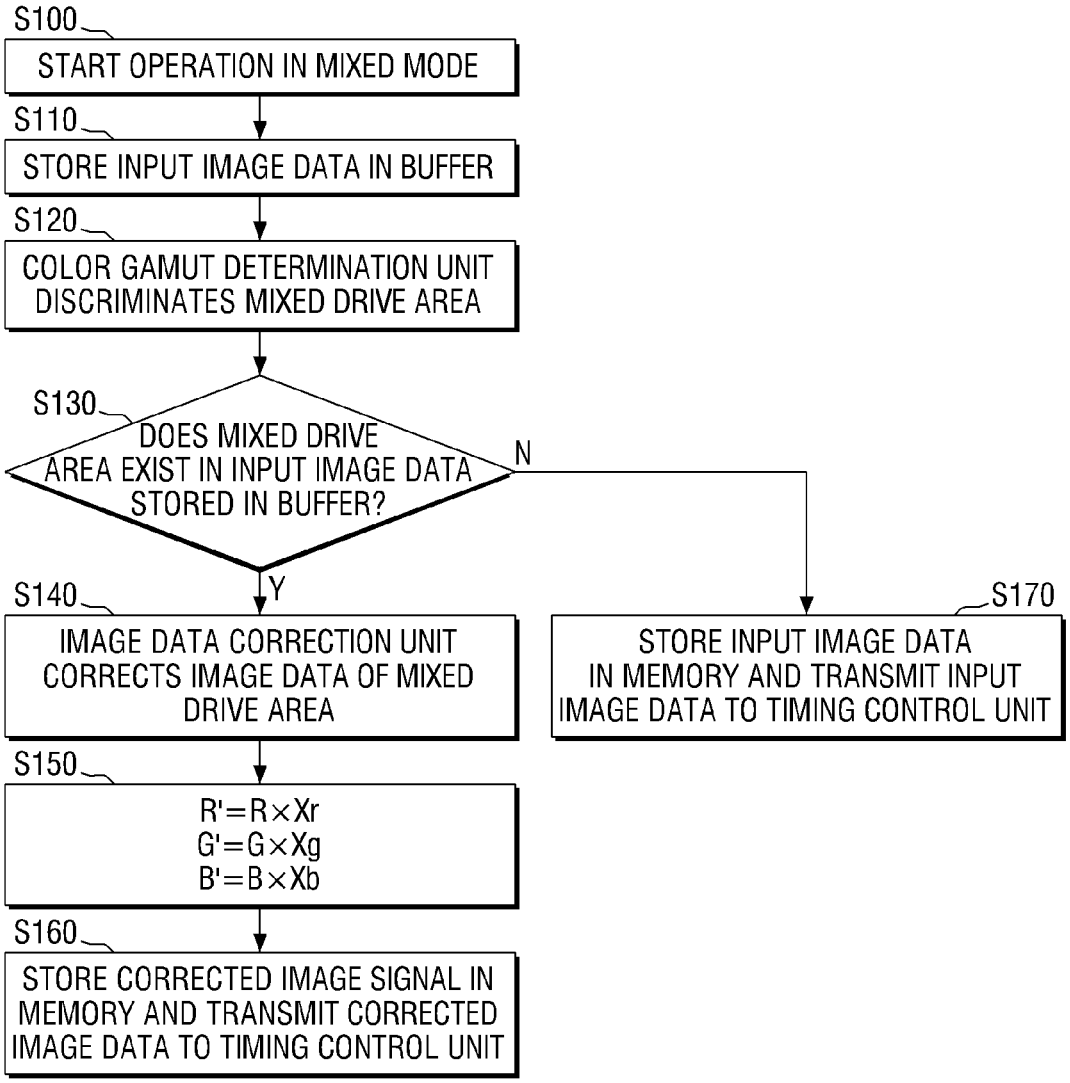
FIG. 11 is a flowchart illustrating an exemplary driving method of an organic light emitting display device according to an exemplary embodiment of the present invention.

FIG. 11 is a flowchart illustrating a driving method of an organic light emitting display device according to the embodiment of the present invention.

The flowchart illustrated in FIG. 11 will be schematically described in stages based on the driving method of the organic light emitting display device according to the embodiment of the present invention as described above, and several matters described in detail above are omitted.

Referring to FIG. 11, first, the organic light emitting display device may start the operation of the "mixed mode" by a user or depending on specific conditions (step S100).

To be more specific, the organic light emitting display device according to an exemplary embodiment of the present invention may be operated in a sky blue mode which is driven only by the first blue sub-pixel B1 in a sky blue color, in a deep blue mode which is driven only by the second blue sub-pixel B2 in a deep blue color, and in a mixed mode which can drive both the first blue sub-pixel B1 and the second blue sub-pixel B2 for the image data of a plurality of frames.

Sky blue light emitted from the first blue sub-pixel B1 is known to generally suppress melatonin which induces sleep of the viewer and to promote serotonin which induces arousal of the viewer. On the other hand, deep blue light emitted from the second blue sub-pixel B2 is known to generally promote melatonin, which induces sleep of the viewer and to suppress serotonin which induces arousal of the viewer.

Therefore, the organic light emitting display device according to an exemplary embodiment of the present invention may be operated in the sky blue mode in daytime which requires relatively high brightness due to bright surrounding light of the display device, and may be operated in the deep blue mode in nighttime which does not require high brightness due to relatively dark surrounding light of the display device and may require sleep induction.

If the user or viewer does not require a biological function of the sky blue or deep blue mode, the organic light emitting display device according to an exemplary embodiment of the present invention operates in the mixed mode and may achieve color reproducibility, long useful life and high energy efficiency.

For reference, the "mixed drive mode" as used herein is a concept that is distinct from the "mixed mode," and it can be understood that when operating strictly in the "mixed mode," the "mixed drive mode" can be executed.

Such a change in the mode of the organic light emitting display device may be carried out by selection depending on the user's preference or according to specific conditions, for example, according to the method of driving the device in different modes for each time with reference to a preset time value.

In this specification, the driving method when the organic light emitting display device operates in the mixed mode is primarily described, and in particular, the mixed mode, in which the first blue drive mode and the mixed drive mode are mixed with each other in the image data corresponding to at least one frame, is described. Hereinafter, the driving method of the organic light emitting display device according to an exemplary embodiment of the present invention when operating in the mixed mode will be described.

Subsequently, the color gamut determination unit 620 may store the raw image data IMAGE that is inputted to the buffer (step S110).

The buffer may be a temporary storage that exists in an integrated circuit that includes the color gamut determination unit 620, or may be an area that is assigned into the memory 126.

Subsequently, the color gamut determination unit 620 discriminates the mixed drive area (step S120).

More specifically, the color gamut determination unit 620 detects the image data belonging to the first color gamut $A_1$, the second color gamut $A_2$ or the third color gamut $A_3$ from the image data stored in the buffer, and discriminates the mixed drive area based on information about the detected color gamuts.

Subsequently, the color gamut determination unit 620 determines whether the mixed drive area exists in the input image data stored in the buffer (step S130).

If the mixed drive area exists in the input image data, the image data correction unit 610 may correct the image data of the mixed drive area (step S140).

Specifically, the image data correction unit 610 may correct the grayscale level of the image data of the mixed drive area so as to match the grayscale versus voltage curve (i.e., the first blue drive mode gamma curve) corresponding to the first blue drive mode or the sky blue drive mode (step S150).

Then, the image data correction unit 610 may store the corrected image signal in the memory 126, and transmit the corrected image data IMAGE' to the timing control unit 122 (step S160).

If the mixed drive area does not exist in the input image data, the image data correction unit 610 may store the input image signal in the memory 126 without correction for the mixed drive area, and transmit the input image data to the timing control unit 122 (step S170).

Figure 12:
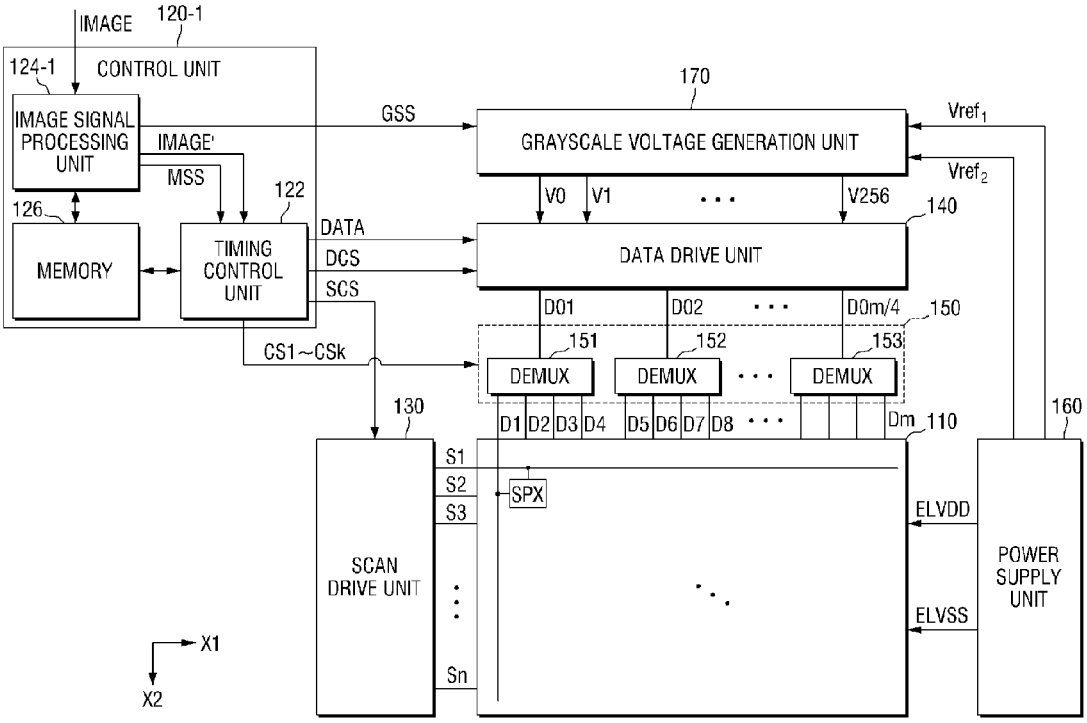
FIG. 12 is a block diagram schematically illustrating an exemplary organic light emitting display device according to another exemplary embodiment of the present invention.

FIG. 12 is a block diagram schematically illustrating an organic light emitting display device according to another exemplary embodiment of the present invention.

In FIG. 12, substantially the same constituent elements as those of the organic light emitting display device according to an exemplary embodiment of the present invention illustrated in FIG. 1 are denoted by the same reference numerals, and a repetitive description thereof will be omitted. Hereinafter, differences between the organic light emitting display device according to the above-described exemplary embodiment of the present invention illustrated in FIG. 1 and the organic light emitting display device according to another exemplary embodiment of the present invention illustrated in FIG. 12 will be described.

Referring to FIG. 12, the organic light emitting display device further includes a display panel 110, a control unit 120-1, a scan drive unit 130, a data drive unit 140, a demultiplexer circuit 150, a power supply unit 160, and a grayscale voltage generation unit 170.

Since the organic light emitting display device according to another exemplary embodiment of the present invention illustrated in FIG. 12 is different from the organic light emitting display device according to the exemplary embodiment of the present invention illustrated in FIG. 1 in that an image data processing unit 124-1 transmits the gamma selection signal GSS to the grayscale voltage generation unit 170 to change the plurality of grayscale voltages V0 to V255 of the grayscale voltage generation unit 170, and it is possible to express the desired grayscale, by changing the plurality of grayscale voltages V0 to V255 to correspond to the mixed blue gamma curve Vgamma_Bmix, without correction for the image data corresponding to the mixed drive area, when the image data corresponding to the mixed drive area is displayed.

Next, the image data processing unit according to another exemplary embodiment of the present invention will be described in more detail with reference to FIG. 13.

Figure 13:
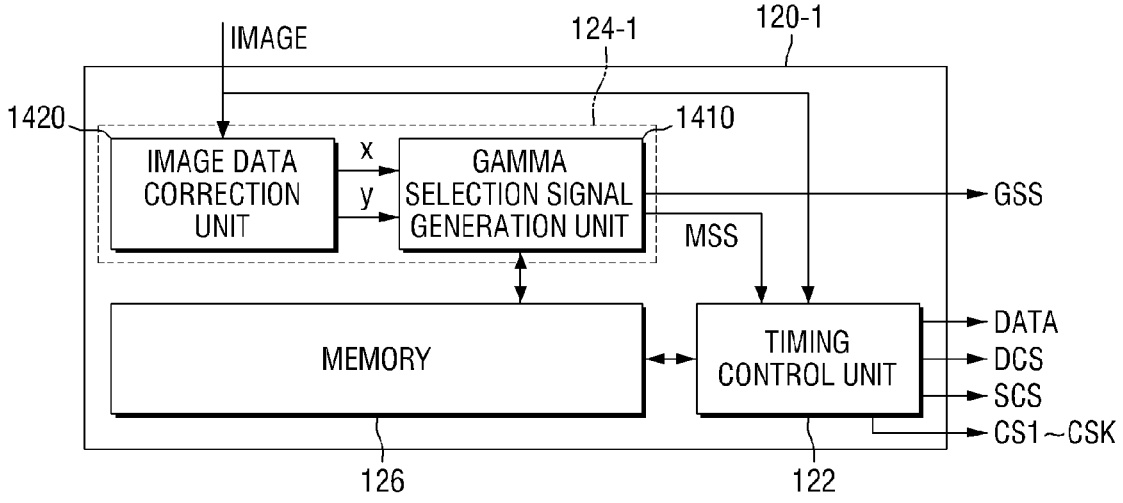
FIG. 13 is a block diagram schematically illustrating an exemplary image data processing unit according to another exemplary embodiment of the present invention.

FIG. 13 is a block diagram schematically illustrating a control unit 120-1 according to another exemplary embodiment of the present invention.

Referring to FIG. 13, the control unit 120-1 includes an image data processing unit 124-1 according to another exemplary embodiment of the present invention, which includes a color gamut determination unit 1420 and a gamma selection signal generation unit 1410.

Since the color gamut determination unit 1420 of the image data processing unit 124-1 according to another exemplary embodiment of the present invention performs substantially the same function as that of the color gamut determination unit 620 of the image data processing unit 124 according to an exemplary embodiment of the present invention discussed above, a repetitive description thereof will be omitted.

The gamma selection signal generation unit 1410 may receive position values (x, y) of the pixel belonging to the second color gamut $A_2$ or the third color gamut $A_3$ in the raw image data IMAGE from the color gamut determination unit 1420, or values for a start point $BL_1$ and an end point $BL_2$ of the mixed drive area, and may provide the gamma selection signal GSS to the grayscale voltage generation unit 170 such that the grayscale voltage generation unit 170 generates a plurality of grayscale voltages V0 to V255 corresponding to the mixed blue gamma curve Vgamma_Bmix when the image data corresponding to the start point $BL_1$ to the end point $BL_2$ of the mixed drive area is displayed on the display panel 110.

The gamma selection signal generation unit 1410 may transmit the mode selection signal MSS, which indicates whether the image data belongs to the first blue drive area or the mixed drive area, to the timing control unit 122, and the timing control unit 122 may transmit the drive selection signals CS1 to CSk corresponding to the received mode selection signal MSS to the demultiplexer circuit 50.

That is, the image data processing unit 124-1 according to another exemplary embodiment of the present invention causes the grayscale voltage generation unit 170 to generate a plurality of grayscale voltages V0 to V255 matching the mixed drive mode when the image data belonging to the mixed drive area is displayed on the display panel 110 in the mixed drive mode, thereby allowing the display panel 110 to appropriately express the grayscale value corresponding to the mixed drive, without separate image data correction.

Figure 14:
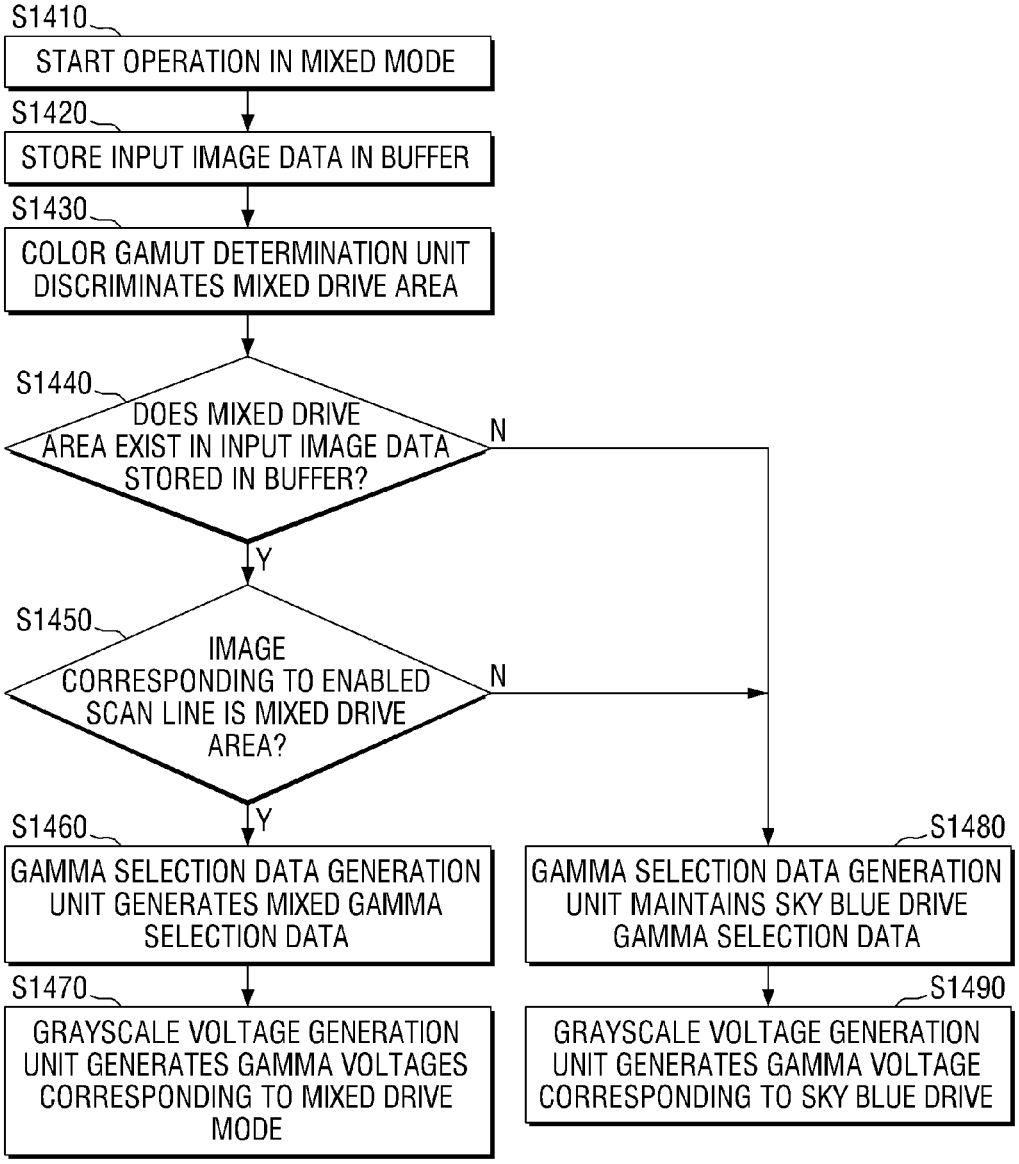
FIG. 14 is a flowchart illustrating an exemplary driving method of an organic light emitting display device according to another exemplary embodiment of the present invention.

FIG. 14 is a flowchart illustrating a driving method of an organic light emitting display device according to another exemplary embodiment of the present invention.

Referring to FIG. 14, first, the organic light emitting display device may start the operation of the "mixed mode" by a user or depending on specific conditions (step S1410).

Subsequently, the color gamut determination unit 1420 may store the raw image data IMAGE that is input to the buffer (step S1420).

The buffer may be a temporary storage that exists in the integrated circuit including the color gamut determination unit 1420, or may be an area that is assigned to the memory 126.

Subsequently, the color gamut determination unit 1420 discriminates the mixed drive area (step S1430).

More specifically, the color gamut determination unit 1420 detects the image data belonging to the first color gamut $A_1$, the second color gamut $A_2$ or the third color gamut $A_3$ from the image data stored in the buffer, and discriminates the mixed drive area based on information about the detected color gamuts.

Subsequently, the color gamut determination unit 1420 determines whether the mixed drive area exists in the input image data stored in the buffer (step S1440).

If the mixed drive area exists in the input image data, it is determined whether the image corresponding to the enabled scan line is an image belonging to the mixed drive area (step S1450).

When the image corresponding to the enabled scan line, i.e., the image data to be displayed on the display panel 110, belongs to the mixed drive area, the gamma selection signal generation unit 1410 may provide a mixed gamma selection signal as the gamma selection signal GSS to the grayscale voltage generation unit 170 such that the grayscale voltage generation unit 170 generates a plurality of grayscale voltages V0 to V255 corresponding to the mixed blue gamma curve Vgamma_Bmix (step S1460).

Then, the grayscale voltage generation unit 170 generates a plurality of grayscale voltages corresponding to the mixed drive mode and transmits the plurality of grayscale voltages to the data drive unit 140 (step S1470).

If the mixed drive area does not exist in the input image data in step S1440, or when the image corresponding to the enabled scan line, i.e., the image data to be displayed on the display panel 110, does not belong to the mixed drive area in step S1450, the gamma selection signal generation unit 1410 may maintain the gamma selection signal GSS corresponding to the sky blue drive mode, i.e., the first blue drive mode (step S1480).

Then, the grayscale voltage generation unit 170 generates a grayscale voltage corresponding to the sky blue mode, i.e., the first blue drive mode, and transmits the grayscale voltage to the data drive unit 140 (step S1490).

Figure 15A:
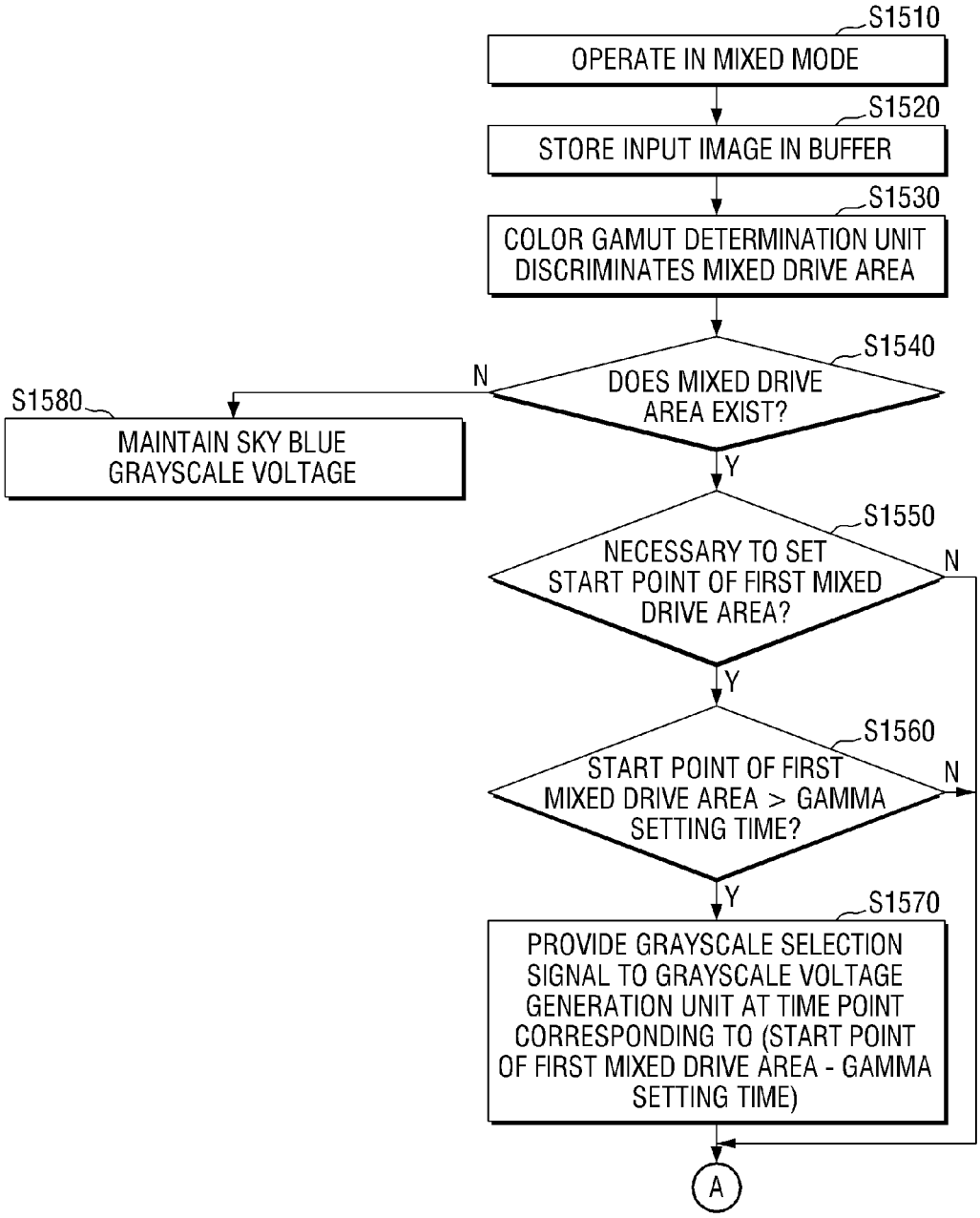
FIG. 15A and FIG. 15B show a flowchart illustrating an exemplary driving method of an organic light emitting display device according to still another exemplary embodiment of the present invention.
Figure 15B:
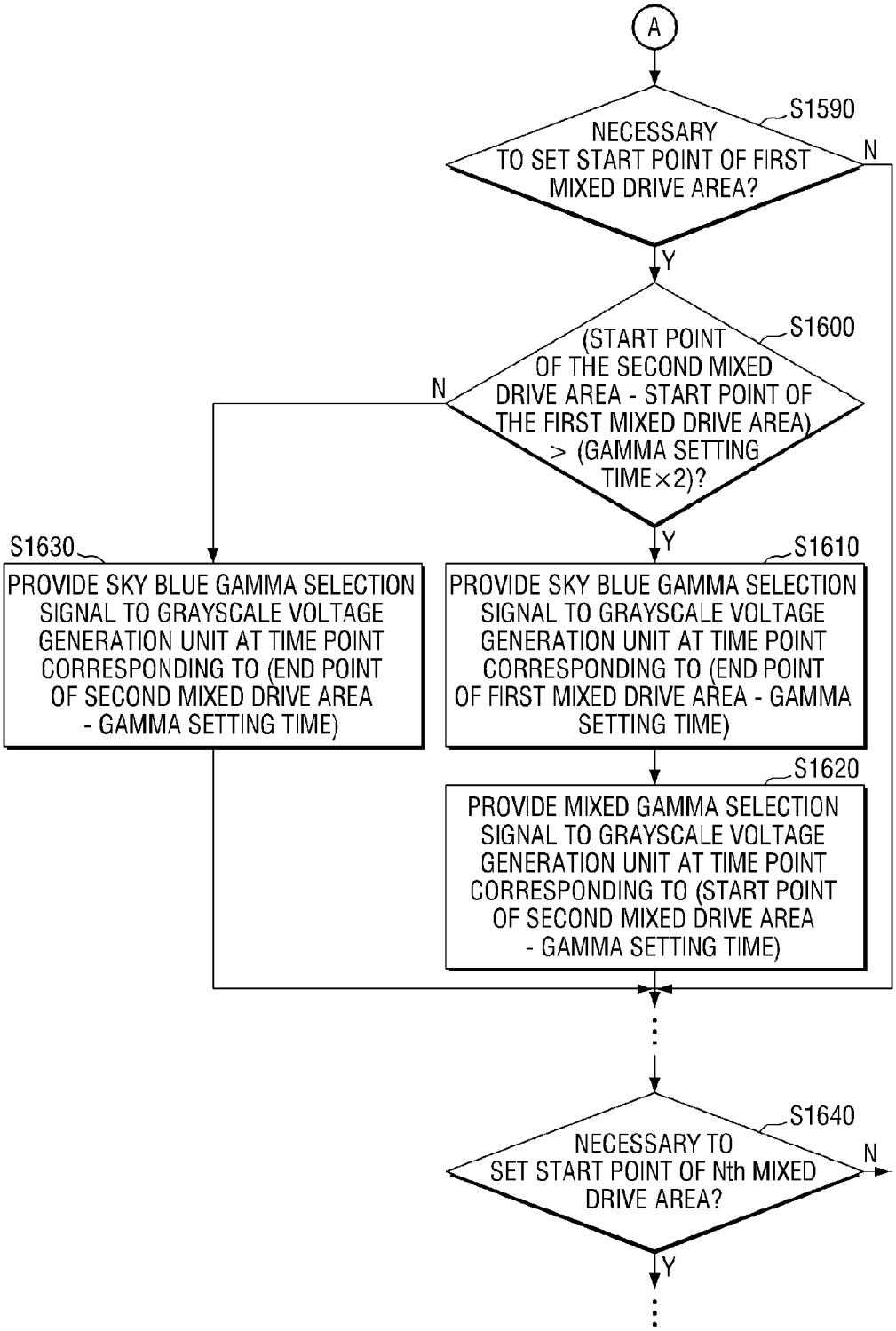

FIGS. 15A and 15B show a flowchart illustrating a driving method of an organic light emitting display device according to still another exemplary embodiment of the present invention.

In the driving method of an organic light emitting display device according to still another embodiment of the present invention shown in FIGS. 15A and 15B, it is further taken into consideration that a plurality of mixed drive areas exist in the image data and the gamma setting time is necessary when the grayscale voltage generation unit 170 changes the grayscale voltage, compared to the driving method of an organic light emitting display device according to another embodiment of the present invention described with reference to FIGS. 12 to 14.

Referring to FIGS. 15A and 15B, first, the organic light emitting display device may start the operation of the "mixed mode" by a user or depending on specific conditions (step S1510).

Subsequently, the color gamut determination unit 1420 may store the raw image data IMAGE that is input to the buffer (step S1520).

The buffer may be a temporary storage that exists in the integrated circuit including the color gamut determination unit 1420, or may be an area that is assigned to the memory 126.

Subsequently, the color gamut determination unit 1420 discriminates the mixed drive area (step S1530).

More specifically, the color gamut determination unit 1420 detects the image data belonging to the first color gamut $A_1$, the second color gamut $A_2$ or the third color gamut $A_3$ from the image data stored in the buffer, and discriminates the mixed drive area based on information about the detected color gamuts.

Further, the image data may include a plurality of mixed drive areas with respect to the scan direction.

Subsequently, the color gamut determination unit 1420 determines whether the mixed drive area exists in the input image data stored in the buffer (step S1540).

If the mixed drive area exists in the input image data, it is determined whether it is necessary to set the start point of the first mixed drive area (step S1550).

The start point of the first mixed drive area may be defined as the time until scanning is performed in the scan direction from the start point of one frame image to the start point of the first mixed drive area.

If it is necessary to set the start point of the first mixed drive area, it is determined whether the start point of the first mixed drive area is greater than the gamma setting time (step S1560).

If the start point of the first mixed drive area is greater than the gamma setting time, at a time point corresponding to the time obtained by subtracting the gamma setting time from the start point of the first mixed drive area, the gamma selection signal GSS corresponding to the mixed drive mode is provided to the grayscale voltage generation unit 170 (step S1570).

If the mixed drive area does not exist in step S1540, the gamma selection signal generation unit 1410 provides the gamma selection signal GSS maintaining the sky blue mode, i.e., the first blue drive mode, to the grayscale voltage generation unit 170 (step S1580).

If it is not necessary to set the start point of the first mixed drive area in step S1550, or if the start point of the first mixed drive area is greater than the gamma setting time in step S1560, or after step S1570 has been performed, it is determined whether it is necessary to set the start point of the second mixed drive area (step S1590).

If it is necessary to set the start point of the second mixed drive area, it is determined whether the time obtained by subtracting the start point of the first mixed drive area from the start point of the second mixed drive area is twice greater than the gamma setting time (step S1600).

If the time obtained by subtracting the start point of the first mixed drive area from the start point of the second mixed drive area is twice greater than the gamma setting time, at a time point corresponding to the time obtained by subtracting the gamma setting time from the end point of the first mixed drive area, the gamma selection signal for operating in the sky blue drive mode, i.e., the first blue drive mode, is provided to the grayscale voltage generation unit 170 (step S1610).

Subsequently, at a time point corresponding to the time obtained by subtracting the gamma setting time from the start point of the second mixed drive area, the gamma selection signal GSS for operating in the mixed drive mode is provided to the grayscale voltage generation unit 170 (step S1620).

If the time obtained by subtracting the start point of the first mixed drive area from the start point of the second mixed drive area is not twice greater than the gamma setting time in step S1600, at a time point corresponding to the time obtained by subtracting the gamma setting time from the end point of the second mixed drive area, the gamma selection signal GSS for operating in the sky blue drive mode, i.e., the first blue drive mode, is provided to the grayscale voltage generation unit 170 (step S1630).

If it is not necessary to set the start point of the second mixed drive area in step S1590, or after step S1620 and step S1630, it is determined whether it is necessary to set the start point of the third mixed drive area, and the process may proceed to step S1640 of determining whether it is necessary to set the start point of the Nth mixed drive area.

Exemplary embodiments of the present invention provide at least the following effects. In an aspect, by distinguishing an area in which a first blue sub-pixel emits light in a sky blue color with long life and excellent energy efficiency, and an area in which a second blue sub-pixel also emits light in a deep blue color with excellent color reproducibility within one image frame, it is possible to provide an organic light emitting display device having high energy efficiency, long life, and excellent color reproducibility.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. An organic light emitting display device comprising:

a display panel comprising red sub-pixels, green sub-pixels, first blue sub-pixels, and second blue sub-pixels, which are respectively connected to a plurality of scan lines and a plurality of data lines;

a scan drive unit configured to sequentially applies a plurality of scan signals to the plurality of scan lines;

a data drive unit configured to receive an image signal and output a plurality of data output signals;

a demultiplexer configured to distribute the plurality of data signals to the data lines connected to the red sub-pixels, the green sub-pixels, and the first blue sub-pixels in response to a first blue drive selection signal, or distribute the plurality of data output signals to the data lines connected to the red sub-pixels, the green sub-pixels, the first blue sub-pixels, and the second blue sub-pixels in response to a mixed drive selection signal; and a control unit configured to process raw image data into an image signal and provide the image signal to the data drive unit, wherein the control unit is configured to detect image data belonging to a first color gamut and a second color gamut from the image data, determine a first blue drive area comprising the image data belonging to the first color gamut and a mixed drive area comprising the image data belonging to the second color gamut, provide the first blue drive selection signal to the demultiplexer when the data output signal corresponding to the first blue drive area is provided from the data drive unit to the demultiplexer, and provide the mixed drive selection signal to the demultiplexer when the data output signal corresponding to the mixed drive area is provided from the data drive unit to the demultiplexer.

2. The organic light emitting display device of claim 1, wherein the control unit comprises an image data processing unit configured to receive the raw image data and generate the corrected image data, and a timing control unit configured to receive the corrected image data from the image data processing unit and process the corrected image data into an image signal.

3. The organic light emitting display device of claim 2, wherein the image data processing unit comprises:

a color gamut determination unit configured to detect image data belonging to the first color gamut and the second color gamut from the image data, and determine the first blue drive area including the image data belonging to the first color gamut and the mixed drive area including the image data belonging to the second color gamut; and an image data correction unit configured to receive values for the first blue drive area and the mixed drive area from the color gamut determination unit, and correct image data belonging to the mixed drive area in the raw image data.

4. The organic light emitting display device of claim 3, wherein the image data correction unit is configured to transmit a mode selection signal, which indicates whether image data of the corrected image data belongs to the first blue drive area or the mixed drive area, to the timing control unit, and the timing control unit is configured to transmit a first blue drive selection signal or a mixed blue drive selection signal to the demultiplexer according to the received mode selection signal.

5. The organic light emitting display device of claim 4, wherein the data drive unit is configured to receive a plurality of grayscale voltages from a grayscale voltage generation unit, select at least one of the received grayscale voltages, and output the selected grayscale voltage as a data output signal.

6. The organic light emitting display device of claim 5, wherein the grayscale voltage generation unit is configured to receive a gamma selection signal provided from the timing control unit, and generate a plurality of grayscale voltages which correspond to a gamma curve in a first blue drive mode in which the red sub-pixels, the green sub-pixels, and the first blue sub-pixels are driven, or a gamma curve in a mixed blue drive mode in which the red sub-pixels, the green sub-pixels, the first blue sub-pixels, and the second blue sub-pixels are driven, depending on the received gamma selection signal.

7. The organic light emitting display device of claim 6, wherein the image data correction unit is configured to correct a grayscale value of the image data belonging to the mixed drive area in the raw image data to match the gamma curve in the first blue drive mode.

8. The organic light emitting display device of claim 7, wherein the control unit further comprises a memory, and the memory is configured to store a reference value related to the gamma curve in the first blue drive mode and the gamma curve in the mixed blue drive mode.

9. The organic light emitting display device of claim 1, further comprising a grayscale voltage generation unit configured to provide a plurality of grayscale voltages to the data drive unit, wherein the data drive unit is configured to select at least one of the received grayscale voltages and provide the selected grayscale voltage as a data output signal to the demultiplexer.

10. The organic light emitting display device of claim 9, wherein the control unit comprises an image data processing unit configured to provide a gamma selection signal to the grayscale voltage generation unit, and a timing control unit configured to receive the raw image data and process the raw image data into the image signal.

11. The organic light emitting display device of claim 10, wherein the image data processing unit comprises:

a color gamut determination unit configured to detect image data belonging to the first color gamut and the second color gamut from the image data, and determine the first blue drive area including the image data belonging to the first color gamut and the mixed drive area including the image data belonging to the second color gamut; and a gamma selection signal generation unit configured to receive values for the first blue drive area and the mixed drive area from the color gamut determination unit, provide a gamma selection signal corresponding to the first blue drive mode to the grayscale voltage generation unit when the data output signal corresponding to the first blue drive area in the raw image data is provided from the data drive unit to the demultiplexer, and provide a gamma selection signal corresponding to the mixed drive mode to the grayscale voltage generation unit when the data output signal corresponding to the mixed drive area in the raw image data is provided from the data drive unit to the demultiplexer.

12. The organic light emitting display device of claim 11, wherein:

when the gamma selection signal corresponding to the first blue drive mode is applied, the grayscale voltage generation unit is configured to generate a plurality of grayscale voltages, depending on the gamma curve corresponding to the grayscale value when the red sub-pixels, the green sub-pixels, and the first blue sub-pixels are driven; and when the gamma selection signal corresponding to the mixed drive mode is applied, the grayscale voltage generation unit is configured to generate a plurality of grayscale voltages, depending on the gamma curve corresponding to the gamma value when the red sub-pixels, the green sub-pixels, the first blue sub-pixels, and the second blue sub-pixels are driven.

13. The organic light emitting display device of claim 11, wherein the image data correction unit is configured to transmit a mode selection signal, which indicates whether image data of the corrected image data belongs to the first blue drive area or the mixed drive area, to the timing control unit, and the timing control unit is configured to transmit a first blue drive selection signal or a mixed blue drive selection signal to the demultiplexer, depending on the received mode selection signal.

14. The organic light emitting display device of claim 1, wherein light emitted from the first blue sub-pixels has a color lighter than light emitted from the second blue sub-pixels.

15. The organic light emitting display device of claim 1, wherein:

the data output signal applied to the demultiplexer circuit is a signal in which a red data signal is applied to the red sub-pixels, a green data signal is applied to the green sub-pixels, and a blue data signal is applied to the first blue sub-pixels, the second blue sub-pixels, or both the first blue sub-pixels and the second blue sub-pixels; and the red data signal, the green data signal, and the blue data signal are sequentially arranged in time.

16. The organic light emitting display device of claim 1, wherein:

the first color gamut is expressed by light emission of the red sub-pixels, the green sub-pixels, and the first blue sub-pixels; and the first color gamut is excluded from the second color, which is expressed by light emission of the red sub-pixels, the green sub-pixels, the first blue sub-pixels, and the second blue sub-pixels.

17. The organic light emitting display device of claim 1, wherein the control unit is configured to:

detect image data belonging to the first color gamut, the second color gamut, and a third color gamut from the image data;

determine the first blue drive area comprising image data belonging to the first color gamut, the mixed drive area comprising image data belonging to the second color gamut, and a second blue drive area comprising the image data belonging to the third color gamut;

provide the first blue drive selection signal to the demultiplexer when the data output signal corresponding to the first blue drive area is provided from the data drive unit to the demultiplexer;

provide the mixed drive selection signal to the demultiplexer when the data output signal corresponding to the mixed drive area is provided from the data drive unit to the demultiplexer;

provide the second blue drive selection signal to the demultiplexer when the data output signal corresponding to the second blue drive area is provided from the data drive unit to the demultiplexer; and distribute a plurality of data output signals to the data lines connected to the red sub-pixels, the green sub-pixels, the first blue sub-pixels, and the second blue sub-pixels.

18. The organic light emitting display device of claim 17, wherein:

the first color gamut is expressed by light emission of the red sub-pixels, the green sub-pixels, and the first blue sub-pixels;

the first color gamut is excluded from the second color gamut, which is expressed by light emission of the red sub-pixels, the green sub-pixels, the first blue sub-pixels, and the second blue sub-pixels; and the first color gamut and the second color gamut are excluded from the third color gamut, which is expressed by light emission of the red sub-pixels, the green sub-pixels, and the second blue sub-pixels.

* * * * *